US005631526A

United States Patent [19]

Ferry

[11] Patent Number: 5,631,526

[45] Date of Patent: May 20, 1997

[54] HYDROGEN ION ACCELERATOR

[75] Inventor: James A. Ferry, Middleton, Wis.

[73] Assignee: National Electrostatics Corp., Middleton, Wis.

[21] Appl. No.: 441,457

[22] Filed: May 15, 1995

[51] Int. Cl.[6] ..... H05H 5/04

[52] U.S. Cl. ..... 315/506; 250/492.3; 250/398; 376/157

[58] Field of Search ..... 315/500, 503, 315/506; 250/492.3, 398; 376/157, 194; 378/57

[56] References Cited

U.S. PATENT DOCUMENTS

| | | | |
|---|---|---|---|
| Re. 34,575 | 4/1994 | Klinkowstein | 328/233 |
| 2,578,908 | 12/1951 | Turner | 315/5 |
| 2,847,611 | 8/1958 | Van de Graaf | 315/30 |
| 3,469,118 | 9/1969 | Herb et al. | 310/6 |
| 3,473,056 | 10/1969 | Ferry | 310/6 |
| 3,609,218 | 9/1971 | Herb et al. | 174/141 |
| 3,612,919 | 10/1971 | Herb et al. | 310/6 |
| 4,326,141 | 4/1982 | Rezvykh et al. | 310/308 |
| 4,789,802 | 12/1988 | Miyake | 310/309 |
| 4,870,287 | 9/1989 | Cole et al. | 315/503 |
| 5,040,200 | 8/1991 | Ettinger et al. | 378/88 |
| 5,175,756 | 12/1992 | Pongratz et al. | 378/88 |
| 5,251,240 | 10/1993 | Grodzins | 376/157 |
| 5,278,418 | 1/1994 | Broadhurst | 250/390.04 |
| 5,293,414 | 3/1994 | Ettinger et al. | 378/88 |
| 5,323,004 | 6/1994 | Ettinger et al. | 250/336.1 |
| 5,363,053 | 11/1994 | Etievant et al. | 315/506 |

OTHER PUBLICATIONS

Proposal Quote submitted to a prospective customer on or about Jun. 6, 1991.

*Primary Examiner*—Michael Horabik
*Assistant Examiner*—Michael Day
*Attorney, Agent, or Firm*—Lathrop & Clark

[57] ABSTRACT

A hydrogen ion accelerator produces a beam current that is at least ten times greater than the current supplied by an electrostatic generator by recycling the unreacted portion of the beam. In one application, a 1.76 MeV proton beam is used to generate 9.172 MeV gamma rays for detecting explosives (nitrogen) via either the $^{13}C$ reaction. The cross-section of the 1.76 MeV proton beam with the carbon 13 target is such that over 95 percent of the beam passes through the target unreacted. In a preferred embodiment, a proton source (52) disposed within a high voltage electrode (32) forms a proton beam that is accelerated along the length of an acceleration tube (46), is bent 180° by bending magnets (70, 72), passes through a target foil (76), is decelerated along the length of a deceleration tube (82), and is returned to the high voltage electrode (32) where the energy contained in the beam is recaptured.

19 Claims, 5 Drawing Sheets

FIG. 4
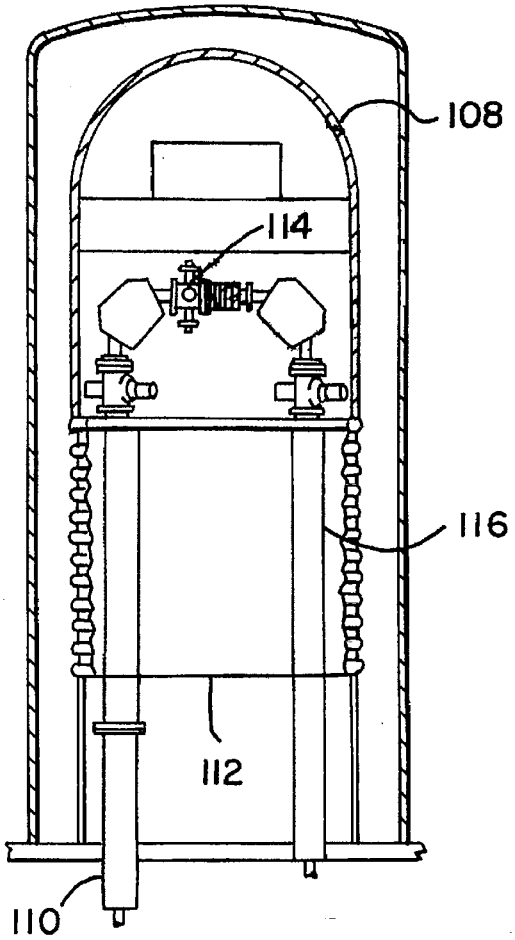
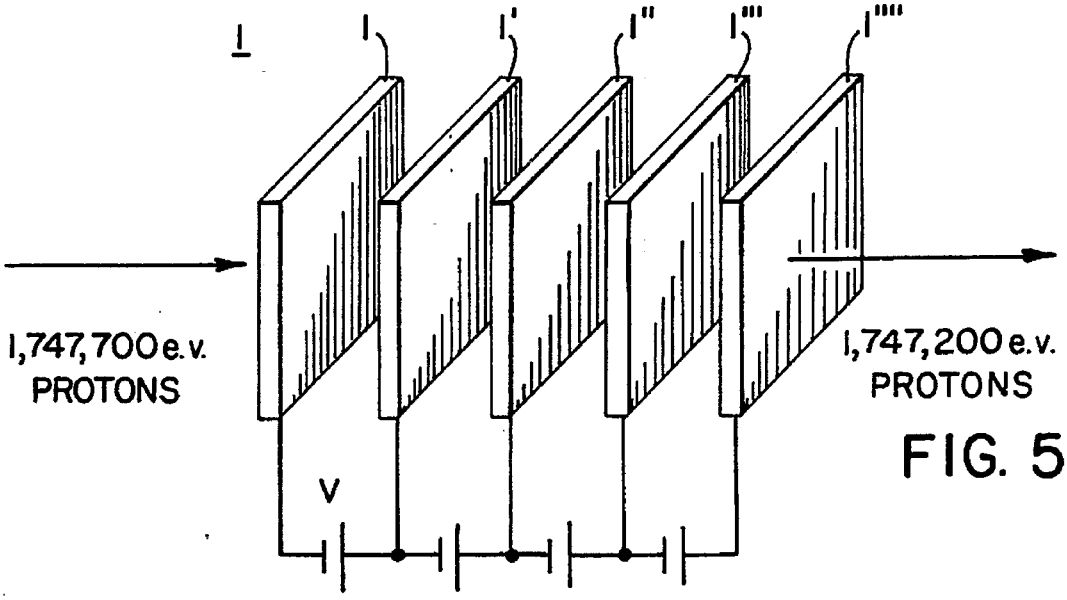
FIG. 5

HYDROGEN ION ACCELERATOR

FIELD OF THE INVENTION

The present invention relates to particle accelerators in general and to electrostatic accelerators in particular.

BACKGROUND OF THE INVENTION

In an electrostatic accelerator, an electrostatic generator is used to accumulate electrical charge on a high voltage electrode which is insulated from the ground. One particularly effective high voltage generator utilizes a series of conductive charge carrying pellets fixed along a chain with insulating elements extending between the pellets. Such a system is disclosed in U.S. Pat. Nos. 3,469,118 and 3,612,919, of which I am co-inventor. In a typical electrostatic accelerator, the high voltage electrode is contained in a pressure vessel which contains high pressure gas, typically sulfur hexafluoride, which resists electrostatic breakdown between the high voltage electrode and the vessel which is grounded. An insulative column supports the high voltage electrode and extends between the grounded vessel and the high voltage electrode. One or more high voltage acceleration tubes extend between the high voltage electrode and the ground. The tubes are comprised of alternating insulative elements with conducting elements.

An even voltage gradient is maintained between the high voltage electrodes and the ground by allowing a small mount of current from the high voltage electrode to cascade down the conductive elements of the acceleration tube through high value resistors which connect the conductive elements. To further improve the shape of the electrostatic field, conductive hoops are placed around the acceleration tube or tubes and again, a small, generally lesser value of current is allowed to cascade down the outer hoops. Thus, a smooth gradient between the high voltage electrode and the ground is produced. Particles, such as electrons, protons, and other positively or negatively charged ions, may be accelerated by injecting them into the acceleration tube so they pass between the high voltage electrode and the ground.

Electrostatic generators are capable of producing extremely high voltages ranging up to over 25 million volts. Such high voltage generators have been widely used in the construction of potential drop accelerators. Historically, ion accelerators have been used in particle physics and condensed matter physics to probe the fundamental laws of nature.

Over time industrial uses have arisen for particle accelerators. For example, the acceleration of doping ions in the semi-conductor field has allowed the precise injection of ions into substrates to form transistors and other semiconductor devices. In the tool industry, the capability of selectively implanting ions into the surface of materials has been used to develop new surface-hardening techniques.

Recently a demand for a high current source of protons or deuterons has been supplied by high current non-electrostatic accelerators. Electrostatic accelerators have not been capable of supplying the high currents necessary for supplying the proton or deuteron beam necessary for certain applications involving the production of gamma rays by proton or deuteron bombardment.

It has been known for many years that, in the construction of a free electron laser using a Van de Graff type electron accelerator, electrons can be recycled to improve the efficiency of the devices.

What is needed is an apparatus and method for facilitating the use of electrostatic accelerators in applications requiring high proton or deuteron beam currents.

SUMMARY OF THE INVENTION

The ion accelerator of this invention can produce a proton beam current between a high voltage electrode and ground plane which is ten times or more the current supplied by an electrostatic generator to the high voltage electrode by recycling the energy of the protons in the beam. In one application for high current accelerators, a 1.76 MeV proton beam is used as a source of gamma rays via the $^{13}C\ (p, \gamma)^{14}N$ reaction. The cross-section of the carbon 13 with the 1.76 MeV protons is such that over 95 percent of the proton beam passes through the target unreacted and is wasted. This may be accomplished in applications where a high current beam is utilized in a nuclear reaction and the majority of the beam passes through a target with little effect on the beam's properties. The accelerator of this invention achieves a high beam current in an accelerator with a small current input by recycling the energy contained in the beam which does not react with the target. In one application it is desirable to generate 9.172 MeV gamma rays which are used in detection of concealed nitrogen concentrations in luggage. Where a five milliamp proton beam is directed against a carbon 13 foil target, only a small percentage of the protons react to produce resonant gamma rays. The remainder with some slight beam degradation pass through the foil target relatively unaffected. In this case, an electrostatic accelerator having a charging current of 500 microamps may be used to produce the five milliamp beam current required. The electrostatic accelerator has an acceleration tube and a deceleration tube. As an ion source produces a five milliamp current which is accelerated down the length of the acceleration tube, the beam is bent 180° by a magnet and passes through a carbon 13 foil and is returned to the high voltage electrode through a deceleration tube where the energy contained in the beam is recaptured at the high voltage electrode.

It is an object of the present invention to provide an electrostatic accelerator which can accelerate a high current beam of particles.

It is another object of the present invention to provide a high current ion source.

It is a further object of the present invention to provide a particle accelerator which achieves high efficiency by recycling unused beam power.

It is a still further object of the present invention to provide a source of gamma rays which are resonantly scattered by nitrogen.

It is yet another object of the present invention to provide a compact unit for detecting nitrogenous compounds in luggage at airports or other passenger terminals.

Further objects, features and advantages of the invention will be apparent from the following detailed description when taken in conjunction with the accompanying drawings.

BRIEF DESCRIPTION OF THE DRAWINGS

FIG. 4 is a cross-sectional view of an alternative embodiment of the accelerator of FIG. 1.

FIG. 5 is a schematic view of multiple $^{13}C$ foil target for use with the accelerator of FIGS. 1 and 4.

DESCRIPTION OF THE PREFERRED EMBODIMENT

Figure 1:
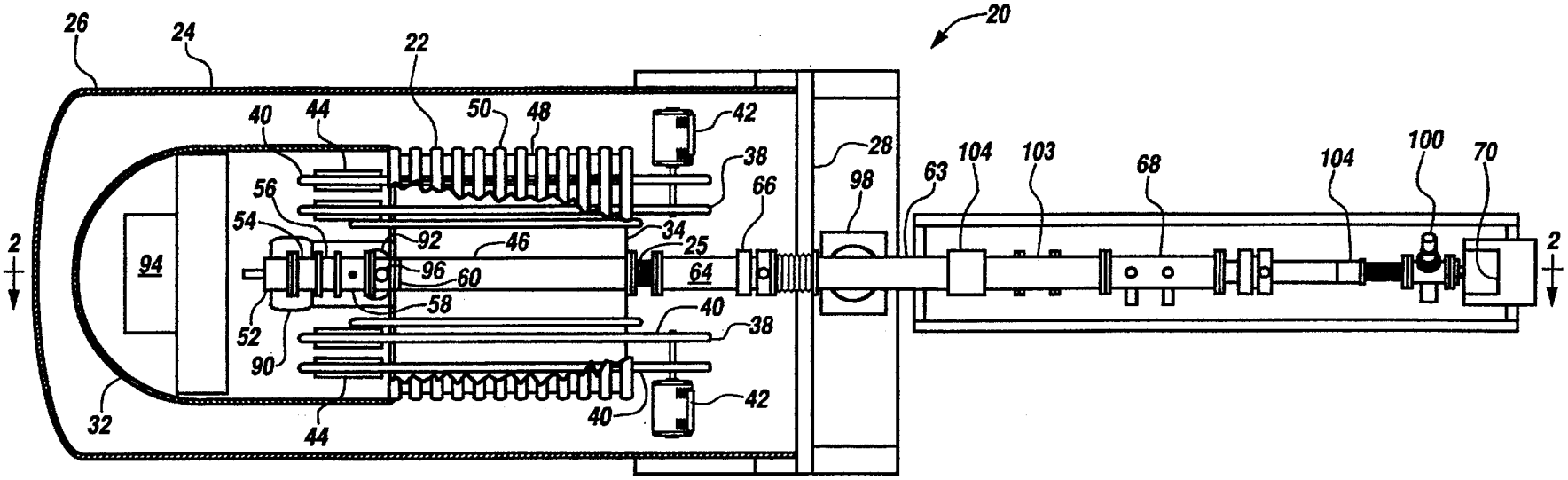
FIG. 1 is a top plan view, partly cut away in section, of a high current accelerator of this invention.
Figure 2:
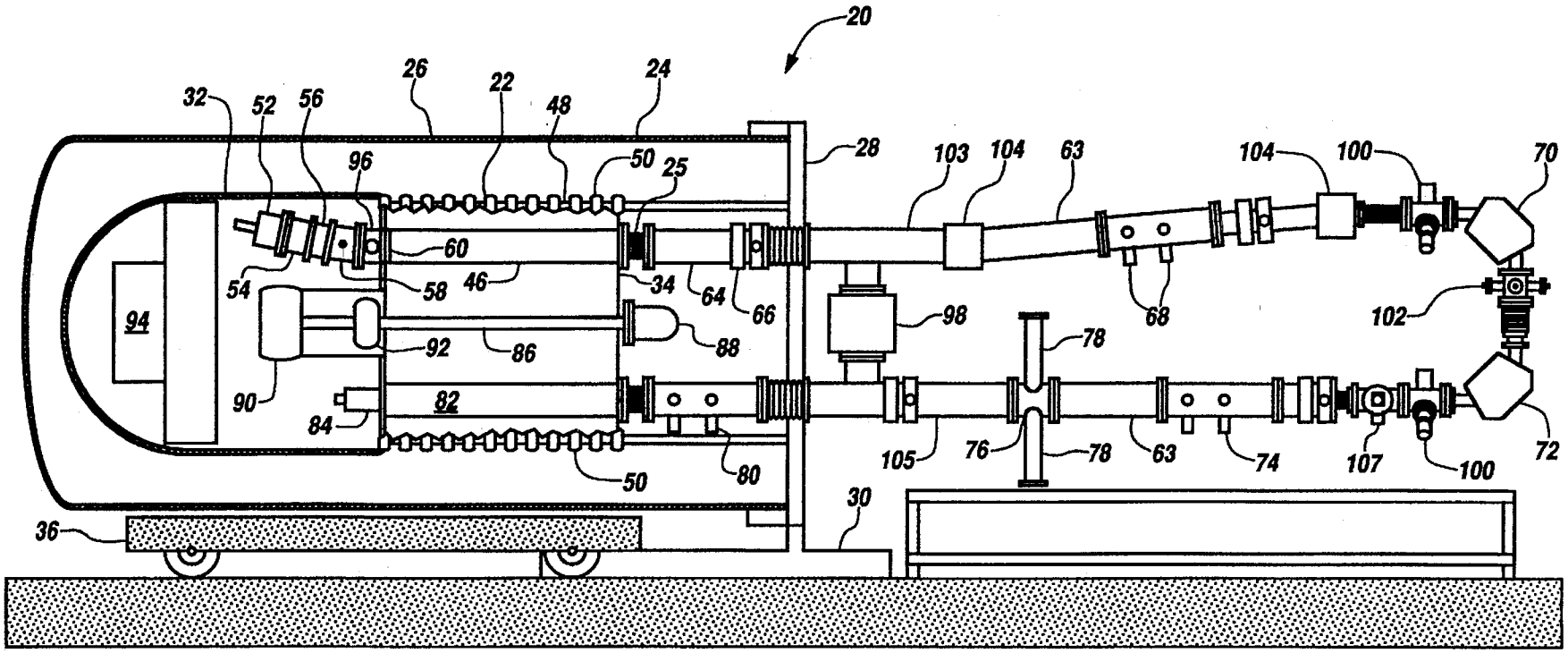
FIG. 2 is a side-elevational cross-sectional view of the accelerator of FIG. 1.
Figure 3:
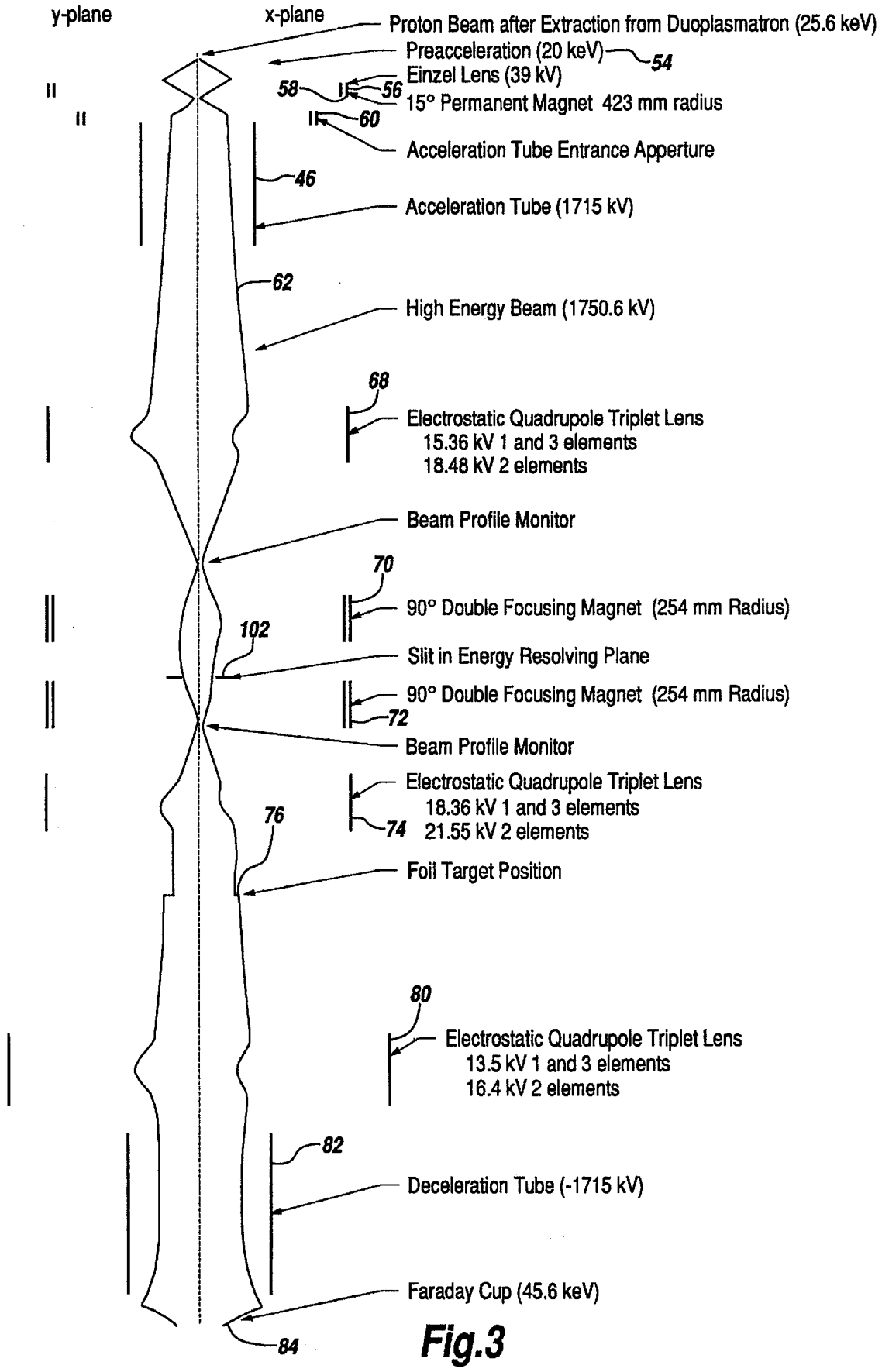
FIG. 3 is a schematic view of the beam profile in the x and y-planes as it moves through the accelerator of FIG. 1.

Referring more particularly to FIGS. 1–3, wherein like numbers refer to similar parts, an apparatus for generating 9.172 MeV gamma rays 20 is shown in FIGS. 1 and 2. The gamma ray generator 20 employs an electrostatic accelerator 22 and is housed in a pressure vessel 24 which in turn is composed of a bell section 26 and an end flange 28. The end flange 28 is mounted on a support 30. The pressure vessel 24 is used to contain high pressure sulfur hexafluoride which has a high dialectic breakdown voltage and thus facilitates the isolation of a high voltage electrode 32 from a ground surface defined by the pressure vessel 24 and ground plane 34. The bell section 26 is mounted on a wheeled cart 36 to facilitate servicing the accelerator 22, which is done by the separation of the bell section 26 from the end flange 28.

The high voltage electrode 32 of the accelerator 22 is charged by an electrostatic generator 38 which is comprised of four charging chains 40 which extend between the ground plane 34 and the high voltage electrode 32. The chains 40 are driven by motors 42 to cause the chains to move between the ground plane and the chain idler assembly 44 located inside the high voltage electrode 32. Motion of the chains 40 carries electric charge to the high voltage electrode 32. The details of such systems are disclosed in U.S. Pat. Nos. 3,469,118 and 3,612,919 which are incorporated herein by reference. The charging chains 40, as shown in FIG. 1, charge the high voltage electrode 32 to 1,715,000 volts. An evacuated acceleration tube 46 extends between the high voltage electrode 32 and the ground plane 34. The high voltage electrode 32 is supported by an insulative column 48 of metal and ceramic support posts which in turn support potential distribution tings 50, see U.S. Pat. No. 3,609,218 which is incorporated herein by reference. Protons are supplied from a duoplasmatron ion source 52 and are extracted and transmitted to the pre-acceleration assembly 54.

As shown in FIG. 3, the proton beam has an energy of 25.6 keV as it is extracted from the duoplasmatron 52. An additional 20 keV acceleration is produced by the pre-acceleration assembly 54. The proton beam is then focused by a 39 keV Einzel lens which is part of the Einzel lens getter pump assembly 56. Following the Einzel lens, the beam is bent fifteen degrees by a permanent magnet 58 and enters the acceleration tube entrance aperture 60 as shown diagrammatically in FIG. 3. The acceleration tube 46 subjects the protons to an accelerating field of 1715 keV. The 1750.6 keV energy beam 62 shown in FIG. 3 exits the acceleration tube 46 and enters an interconnect tube 64 which is joined by an interconnecting bellows 25. The beam then passes through an x-y steerer 66 and exits the pressure vessel 24 through a vacuum feed into an evacuated beam enclosure 63. As shown diagrammatically in FIG. 3 and illustrated in FIG. 2, an electrostatic quadrupole triplet lens 68 focus the beam.

The beam 62, still contained within the evacuated enclosure 63, is bent ninety degrees by a first double focusing bending magnet 70 whereupon the beam 62 is bent a further ninety degrees by a second bending magnet 72. The high energy beam 62 is thus bent one hundred eighty degrees to direct it back towards the pressure vessel 24. A second quadrupole triplet lens 74 expands the beam's profile so that a beam of uniform but expanded cross-section may uniformly interact with a $^{13}C$ foil 76. The beam interacts with the carbon of the foil 76 to produce resonant gamma rays of 9.172 MeV. The gamma rays are emitted axially symmetrically about the beam path. Gamma rays emitted are collimated (collimator not shown) into useful directions so that they may pass through luggage or other items in which it is desirable to detect high concentrations of nitrogen.

It should be noted that Item 78 depicts apparatus to hold many $^{13}C$ foils which can be placed into the beam when the foil being used degrades or breaks and can no longer be used.

A 9.172 MeV x-ray collimator would be made up of heavy lead blocks with a hole or slot defining the useful direction.

The nuclear reaction which produces the 9.172 MeV gamma rays of interest, takes place only for a narrow range of proton energies. Thus the impinging proton beam must have almost precisely 1,747,600 electron volts of energy. If the protons have 150 electron volts too much or too little energy, the resonance will be missed and the reaction will not take place effectively. Because the protons in the beam lose energy as they penetrate the $^{13}C$ foil, the target is very thin.

Nuclear physicists use units of micrograms per square centimeter for describing target thicknesses with 50 angstroms of carbon foil being about one microgram per square centimeter. Currently foils as thin as two micrograms per square centimeter can be fabricated. Nevertheless, practical foils are likely to be in the neighborhood of five to twenty micrograms per square centimeter with 10 micrograms being a likely number. However, even a five microgram per square centimeter foil causes the proton beam to lose energy equivalent to about eight hundred volts of its energy as it traverses the foil. Thus, thick film foil targets are useless for producing more gamma rays. On the other hand, the thin foils which are thus employed allow the vast majority, over ninety-nine percent, of the beam's protons to transit the foil. Less than one in 2×107 protons interact with the target to form gamma rays. In a conventional apparatus for producing resonant reaction gamma rays, the beam after passing through the target, is no longer suitable for producing the nuclear reaction desired and so is discarded. In the gamma ray generating apparatus 20 of FIGS. 1 and 2, protons, after passing through the foil target 76, are focused by a third electrostatic quadrupole triplet lens 80 and injected into the deceleration tube 82. The protons, in passing up through the 1750 kV field produced between the high voltage electrode 32 and the ground plane 34, are decelerated and give up their kinetic energy as they gain in potential energy until they reach the high voltage electrode where the protons are absorbed in a Faraday cup collector 84.

Electrostatic generators of the Van de Graff type are typically charged by transporting electrical charge between a ground plane and a high voltage electrode. Movement of a charged particle through a potential field requires work. In the case of an electrostatic generator, the work is normally provided by electric motors which drive a charge carrying belt, or pellet chain such as shown in FIG. 1. Thus the work produced by the motors 42 in FIG. 1 is converted into potential energy as electrical charges are carried to the high voltage electrode. In a similar way, water could be hoisted by a chain of buckets to the top of a water tower where the water would gain in potential energy. An alternative way of transporting water to the top of a water tower, though perhaps less practical, would be by spraying the water to the top of the tower with a high velocity jet of water. As the water in the jet progresses up against gravity, it is slowed down as its kinetic energy is exchanged for potential energy until the slow moving water is caught and retained at the top of the tower. In a similar way, rather than mechanically transporting electrical charge to the high voltage electrode of the electrostatic, the charges may be transported to the electrode by means of protons having sufficiently high starting velocity where they are caught in the Faraday cup 84 of the high voltage electrode.

The protons are accelerated as they are extracted from the duoplasmatron ion source 52 and accelerated by the pre-acceleration assembly 54. Thus the protons enter the acceleration tube with a velocity corresponding to 46.6 KeV. The high energy beam 62 experiences little or no velocity loss as it transits the beam enclosure 63 and is bent 180° to pass through the target foil 76. The foil removes only a few hundred to a few thousand electron volts of energy and velocity. The residual beam thus has sufficient velocity to transit the deceleration tube between the ground plane and the high voltage electrode and impact and be absorbed by the Faraday cup.

While individual protons lose little energy in making the trip from the high voltage electrode through the target foil and back to the high voltage electrode, losses of protons do occur. The losses are principally resultant from the scattering within the acceleration and deceleration tubes which are due to the less than perfect vacuum and the interaction with the target foil.

Loss of current from the high voltage electrode is associated with the need to maintain a uniform potential along both the acceleration tube and the potential distribution rings. These rings can become discharged through electrical corona discharging and beam interactions with the tube. The acceleration and deceleration tube is made up of a plurality of ceramic rings with titanium plates positioned therebetween. An extremely uniform field is maintained by draining current through a series of high voltage resistors connected to the titanium plates. A typical configuration for the acceleration and deceleration tube is shown in U.S. Pat. No. 5,463,268 for a Magnetically Shielded High Voltage Electron Accelerator. In the case of a proton accelerator, magnetic shielding is undesirable and small permanent magnets are positioned along the acceleration and deceleration tubes to prevent stray electrons from being accelerated along the tubes. The electrostatic generator 38 illustrated in FIGS. 1 and 2 is designed to provide six hundred microamps of charging current to the high voltage electrode 32. The current drains are provided by resistors mounted in series along the acceleration tube 46 and the deceleration tube 82 and the current so used amounts to fifty microamps along each tube. A current of twenty-five microamp is drained down the charge distribution support frames 50.

Twenty-five microamps is dissipated by the corona Triode (not shown) which functions to maintain a constant voltage at the high voltage electrode 32. In total, this leaves a net current for the beam of four-hundred-and-fifty microamps. This current, when added to the current recovered through the recirculation of the protons through the deceleration tube, should produce a beam current of over two milliamps.

To facilitate the function of the accelerator components located at the high voltage electrode, power is transmitted to within the high voltage electrode by a rotating insulative shaft 86. See U.S. Pat. No. 3,473,056 which is incorporated by reference herein. The shaft 86 is driven by a motor 88 and in turn drives a first permanent magnet generator 90 for supplying the ion source potential and a second permanent magnet generator 92 for providing terminal potential to the high voltage terminus of the charging chain 40.

Terminal supply boxes 94 are in turn driven by the generators 90, 92 to supply power to the duoplasmatron 52, the extractor and the pre-acceleration assembly 54 and the Einzel lens and the getter pump assembly 56 as well as the terminal ion pump 96.

The high voltage electrode 32 is about fifty-five inches in diameter and about sixty-eight inches in length. The duoplasmatron ion source extractor, getter pump, pre-acceleration tube, Einzel lens, and 15° permanent magnet are provided within the high voltage electrode 32 and positioned in front of the acceleration tube to generate and inject the proton beam into the accelerator tube 46.

The Faraday cup collector 84 with power supplies is provided at the terminus of the deceleration tube 82 to stop and measure the decelerated proton beam 62.

Other elements of the apparatus 20 which are necessary or facilitate its functions are sputter ion pumps (not shown) located at the terminal ends of the acceleration tube 46 and the deceleration tube 82. The acceleration tube terminal end requires two thirty-liter-per-second sputter ion tubes and the deceleration tube requires a single thirty-liter-per-second sputter ion pump. Two 120 l/s pumps are provided to pump the ground ends of the acceleration and deceleration tubes and are located within the pumping station 98 shown in FIG. 2. With the vacuum pumps, as provided above, it is expected that the vacuum conditions at the terminal end of the acceleration tube can be in the below $10^{-5}$ Torr region and that the vacuum conditions at the end of the deceleration tube will be in the below $10^{-6}$ Torr region or about $10^{-8}$ Torr.

Beam profile monitors 100 are provided on either side of the bending magnets 70. These monitors 100 intercept less than 0.5 percent of the beam and permit the quadrupole triplet lenses 68 to be adjusted for proper beam transmission around the two magnets 70. In addition to the Faraday cup 84 at the terminal end of the deceleration tube 82 a second cup, 107 is used at low currents, 100 microamps or less, and may be positioned before or after the deflection magnets 70 and 72. The second cup can be used to measure beam transmission from the ion source to the second cup. This measurement can be compared with the transmissions to the first cup 84 to determine level of recycling. A two jaw slit 102 is provided in the magnetic chamber between the magnets 70 and 72. This slit 102 is used as part of the acceleration voltage stabilization system.

In order to provide room between the bending magnets 70 and 72 for the two jaw slit 102, the outbound leg 103 of the beam enclosure 63 has two five-degree deflection magnets 104 which serve to space the outward leg of the beam enclosure 63 further from the inbound leg 105.

After the beam passes through the target 76 it is focused by a third electrostatic quadrupole triplet lens 80 which focus the high energy beam 62 for injection into the deceleration tube 82.

Figure 6:
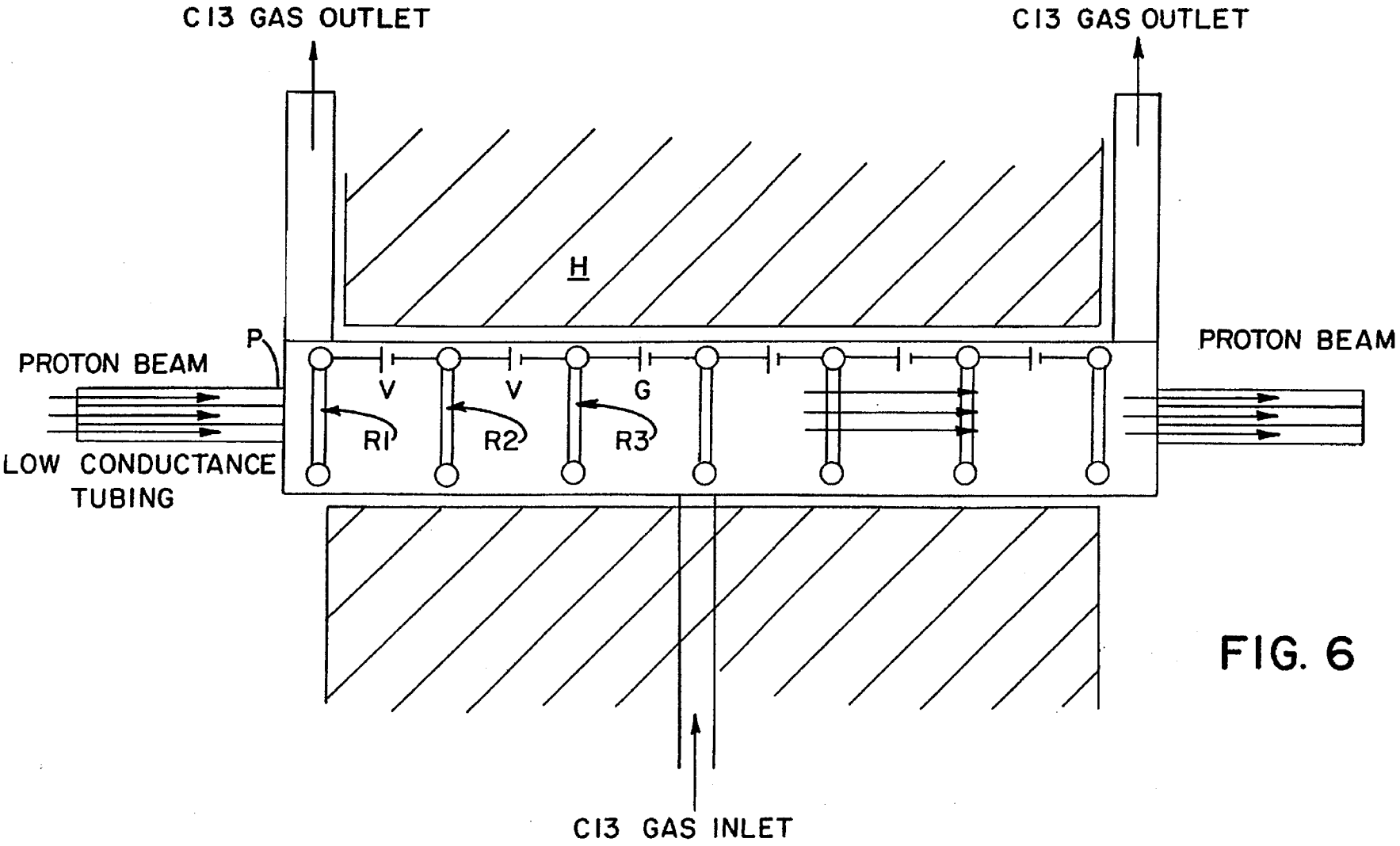
FIG. 6 is a schematic view of a gas target for use with the accelerator of FIGS. 1 and 4.

It should be understood that a current flow may be a flow of negative or positive charge. Thus, in the preferred embodiment the high voltage electrode 32 is positively charged so as to repel protons down the acceleration tube 46. It should be understood, however, as shown in FIG. 6 that the high voltage electrode 108 could be negatively charged and the ion source 110 could be located at the ground plane 112 with respect to the high voltage electrode 108, so that protons would be accelerated towards the electrode, pass through the target 114 inside the electrode 108, and be recycled by deflection into a deceleration tube 116 that leads to the ground plane 112.

It should also be understood that although the method and apparatus for recycling protons and deuterons may most advantageously be used with an electrostatic accelerator to increase the current of protons or deuterons achievable with such an accelerator, the recycling process could be utilized with accelerators of the high voltage solid state type which would perform the same function for reducing the amount of high voltage charging currents required to produce a proton or deuteron beam of a given current.

It should also be understood that the recycling of protons could be used in conjunction with targets composed of multiple foils of a selected composition, the foils having accelerating potentials between the foils about equal to the energy loss of the beam as it transits each foil. This concept is disclosed in U.S. Pat. No. 5,251,240 to Grodzins which is incorporated by reference herein. In Grodzins it is suggested that beam current can be reduced by a factor of 10–100. If the method of Grodzins is combined with the apparatus 20 the current required might be reduced by a factor of 20 or more. Beam degradation due to accumulated foil thickness will limit this method to a few 10 $\mu gm/cm^2$ thickness.

It is understood that the invention is not limited to the particular construction and arrangement of parts herein illustrated and described, but embraces such modified forms thereof as come within the scope of the following claims.

I claim:

1. A hydrogen ion accelerator which recycles hydrogen ions comprising:

a) a ground plane;

b) a high voltage electrode spaced from and electrically isolated from the ground plane at a selected potential;

c) a first source of high voltage current, in supplying relation to the high voltage electrode;

d) an acceleration tube extending from the high voltage electrode to the ground plane;

e) a deceleration tube extending from the ground plane to the high voltage electrode;

f) a hydrogen ion source producing an hydrogen ion beam having a current greater than the current supplied by the first source of high voltage current, the ion beam having a current greater than the current supplied by the first source and being accelerated between the high voltage electrode and the ground plane along the acceleration tube, and across the potential between the high voltage electrode and the ground plane, wherein the ion beam defines a beam path, wherein a first portion of the beam path extends from the high voltage electrode to the ground plane, a second portion of the beam path extends from the ground plane to the high voltage electrode, and a third portion of the beam path extends between the first beam path portion and the second beam path portion;

g) at least one magnet having a magnetic field of sufficient strength and a shape so as to cause the hydrogen ion beam produced by the ion source and accelerated by the potential between the high voltage electrode and the ground plane to traverse the third portion of the beam path between the acceleration tube and the deceleration tube;

h) a target interposed in the third portion of the beam path between the acceleration tube and the deceleration tube, wherein the target allows passage of a majority of the ion beam; and i) a beam collector mounted at the high voltage electrode in receiving relation to the deceleration tube, wherein the hydrogen ion beam path extends from the hydrogen ion source through the acceleration tube and through the deceleration tube and terminates at the collector, and wherein the beam is captured at the high voltage electrode, thus supplying a second source of current to the high voltage electrode by recycling the hydrogen ion beam.

2. The apparatus of claim 1 wherein: the first source of high voltage current is an electrostatic generator.

3. The apparatus of claim 1 wherein the ion beam after acceleration in the acceleration tube has a current at least two times the current supplied by the first source of high voltage current.

4. The apparatus of claim 1 wherein said selected potential is about 1,715,000 Volts and wherein the target material is $^{13}C$.

5. The apparatus of claim 1 wherein the target is a solid foil.

6. The apparatus of claim 5 wherein the target is composed more than one foil of a selected composition and further comprising accelerating potentials between the foils about equal to the energy loss of the beam as it transit each foil.

7. The apparatus of claim 1 wherein the target is a gas.

8. The apparatus of claim 1 wherein there are multiple targets interposed in the hydrogen ion beam and further comprising at least one acceleration electrode between said multiple targets to accelerate said ion beam.

9. The apparatus of claim 1 wherein the target is composed of a gas of a selected composition and further comprising accelerating potentials at selected locations within the gas, said accelerating potentials being about equal to the energy loss of the beam as it transits each selected location with in the target.

10. A method of generating gamma rays comprising the steps of:

a) charging a high voltage electrode from a first source of high voltage current;

b) generating a hydrogen ion beam and passing it through an acceleration tube between the high voltage electrode and a ground plane:

c) bending the hydrogen ion beam through about 180° so it returns to the high voltage electrode;

d) passing the beam through a target before returning the hydrogen ion beam to the high voltage electrode;

e) generating gamma rays of a selected energy through beam interaction with the target; and f) recovering energy from the beam by decelerating the hydrogen ion beam after it passes through the target by returning the beam to the high voltage electrode thus collecting charge from the beam at the high voltage electrode.

11. The method of claim 10 where in the hydrogen ion beam is accelerated to about 1750.6 keV and wherein the target is composed of $^{13}C$.

12. The method of claim 10 wherein the step of passing the beam through a target further comprises passing the beam through a multiplicity of targets, said multiplicity of targets succeeding one another, and accelerating the beam between each of said targets through a voltage potential sufficient to overcome energy losses due to the beam's passage through each succeeding target.

13. A method of detecting nitrogen comprising the steps of:

a) charging a high voltage electrode from a first source of high voltage current;

b) generating a hydrogen ion beam and passing it through an acceleration tube between the high voltage electrode and a ground plane:

c) bending the hydrogen ion beam through about 180° so it returns to the high voltage electrode;

d) passing the beam through a target before returning the hydrogen ion beam to the high voltage electrode;

e) generating gamma rays of a selected energy through beam interaction with the target; and f) recovering energy from the beam by collecting charges from the beam at the high voltage electrode; and wherein the hydrogen ion beam is accelerated to about 1750.6 keV and wherein the target is composed of $^{13}C$, and detecting concealed concentrations of nitrogen by passing the generated gamma rays through an object containing concealed concentrations of nitrogen.

14. A hydrogen ion accelerator, comprising:

a) a ground plane;

b) a high voltage electrode spaced from and electrically isolated from the ground plane at a selected potential;

c) a first source of negative high voltage current, in supplying relation to the high voltage electrode;

d) an acceleration tube extending from the ground plane to the high voltage electrode;

e) a deceleration tube extending from the high voltage electrode to the ground plan;

f) an hydrogen ion source producing an ion beam having a current greater than supplied by the first source of high voltage current, the ion beam being acceleration between the ground plane and the high voltage electrode along the acceleration tube, and across the potential between the ground plane and the high voltage electrode, the ion beam defining a beam path;

g) at least one magnet having a magnetic field of sufficient strength and a shape so as to cause the hydrogen ion beam produced by the ion source and accelerated by the potential between the high voltage electrode and the ground plane to traverse a portion of the beam path between the acceleration tube and the deceleration tube;

h) a target interposed in the beam path between the acceleration tube and the deceleration tube, wherein the target allows passage of a majority of the ion beam; and i) a beam collector mounted at the ground plane in receiving relation to the deceleration tube, wherein the hydrogen ion beam path extends from the hydrogen ion source through the acceleration tube and through the deceleration tube and terminates at the collector, and wherein the beam is captured at the ground plane, thus because the high voltage electrode is negatively charged the hydrogen ion beam is recycled by returning the beam to the ground plane.

15. The apparatus of claim 14 wherein the first source of high voltage current, is an electrostatic generator.

16. The apparatus of claim 14 wherein the ion beam after acceleration in the acceleration tube has a current at least two times the current supplied by the first source of high voltage current.

17. The apparatus of claim 14 wherein the selected potential is about 1,715,000 Volts and wherein the target material is $^{13}C$.

18. The apparatus of claim 14 wherein the target is a solid.

19. The apparatus of claim 14 wherein the target is a gas.

* * * * *